US006346149B1

(12) United States Patent
Gregoire et al.

(10) Patent No.: US 6,346,149 B1
(45) **Date of Patent: *Feb. 12, 2002**

(54) MOISTENING SYSTEM AND DEVICE

(75) Inventors: Jean-Pierre Gregoire, Bagneux; Michel Bonnion, Clichy, both of (FR)

(73) Assignee: Neopost Industrie, Bagneux (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/690,168

(22) Filed: Oct. 16, 2000

Related U.S. Application Data

(63) Continuation of application No. 07/584,667, filed on Sep. 19, 1990.

(30) Foreign Application Priority Data

Sep. 28, 1989 (FR) ..... 89 12707

(51) Int. Cl.[7] ..... B05C 11/00

(52) U.S. Cl. ..... 118/264; 118/268; 118/270

(58) Field of Search ..... 118/429, 264, 118/270, 238, 247, 268; 156/442.2, 442.1

(56) References Cited

U.S. PATENT DOCUMENTS

| | | | |
|---|---|---|---|
| 188,185 | A | 3/1877 | Prentis |
| 425,547 | A | 4/1890 | Peregrine |
| 2,140,178 | A | 12/1938 | Wesselman |
| 2,232,708 | A | 2/1941 | Krueger |
| 2,609,790 | A | 9/1952 | Uhl |
| 2,693,168 | A | 11/1954 | Hummel |
| 3,004,515 | A | 10/1961 | Hummel |
| 4,380,209 | A | 4/1983 | Reid |
| 4,948,453 | A | 8/1990 | Nobile |

FOREIGN PATENT DOCUMENTS

| | | |
|---|---|---|
| FR | 635211 | 12/1927 |
| FR | 2195532 | 3/1974 |

*Primary Examiner*—Brenda A. Lamb
(74) *Attorney, Agent, or Firm*—Sughrue Mion, PLLC

(57) ABSTRACT

A moistening system suitable for mail handling systems comprises a moistening member mounted vertically on a water reservoir from which it is fed with water and on which it has a projecting part. The reservoir is mounted with the moistening member below the path, the length of the reservoir substantially corresponding to the width of the path. The reservoir is divided along its length into independent individual departments into which the moistening member dips.

3 Claims, 5 Drawing Sheets

MOISTENING SYSTEM AND DEVICE

This is a continuation of application Ser. No. 07/584,667 filed Sep. 19, 1990, the disclosure of which is incorporated herein by reference.

BACKGROUND OF THE INVENTION

1. Field of the Invention

The present invention concerns a system for moistening envelope flaps in automatic mail handling installations.

2. Description of the Prior Art

Known moistening systems essentially comprise a moistening member fed directly or indirectly from a reservoir of water which in some cases carries it and against which rub the flaps of successive envelopes fed along a path.

The moistening member must be fed with a sufficient but not excessive amount of water to enable it to transfer water cleanly to the flap rubbing against it. The means for feeding it from the reservoir and the reservoir itself must be designed to prevent any splashing as a result of vibration of the installation or during mounting it on or demounting it from the installation.

Known moistening systems designed to meet these requirements and of greater or lesser complexity have the water reservoir mounted at a distance from the moistening member and consequently from the path followed by the envelopes and their flaps.

The document FR-A-2 195 532 describes one embodiment of a device of this kind for moistening and folding envelope flaps. For the moistening function the device includes a water reservoir, a wick support arm inclined slantwise from the top of the reservoir and a wick with one end in the reservoir and the other end mounted on a wick holder and passing through the wick support arm. The wick support arm has an elongate marginal portion which exposes an elongate portion of the wick through an elongate open portion of the wick holder. The wick holder is J-shape in cross-section with projections which pierce the wick to hold it in place and is adapted to be placed in the wick support arm. This moistening system is disposed below a platform with the exposed portion of the wick substantially under one edge of the platform. An associated deflector at the upstream end engages the envelope flap projecting freely from the edge of the platform over which the body of the envelope is fed, and guides it below the lower edge of the wick support arm. A complex folding system then folds the flap, pushing its gummed region firmly against the wick.

An object of the present invention is to provide a moistening system of significantly simplified design and operation which additionally has compact overall dimensions within the mail handing installation, involves no difficulties of mounting in or demounting from the installation and avoids the possibility of splashing.

SUMMARY OF THE INVENTION

In one aspect, the present invention consists in a moistening system comprising a moistening member and a reservoir, said member being mounted on said reservoir and having a projecting part for moistening articles as they move along a path and are applied to it, in which system said reservoir is mounted with said moistening member that it carries transversely below the path over substantially the entire width of the path and includes a series of partitions dividing it across the width of the path into independent compartments individually supplying water to said moistening member.

According to another characteristic of the invention the reservoir is long and narrow, its length being substantially equal to the width of the path, it has partitions extending heightwise and widthwise, and its upper surface is closed by a lid through which the moistening member passes.

According to another characteristic of the invention the moistening member is a flat member mounted on a holder which secures it to the lid and in the reservoir.

According to another characteristic of the invention the lid has a base covering the reservoir and surmounted by at least one chimney for receiving and holding the moistening member, with its holder, in each compartment of the reservoir.

According to another characteristic of the invention the base is additionally provided with a compartment feed trough formed by one side of the chimney.

The trough has in its base a series of holes discharging into the respective compartments and closed by a strip of plugs.

In another aspect, the present invention consists in a moistening device comprising a moistening system and a reservoir, said member being mounted on said reservoir and having a projecting part for moistening articles as they move along a path and are applied to it, in which system said reservoir is mounted with said moistening member that it carries transversely below the path over substantially the entire width of the path and includes a series of partitions dividing it across the width of the path into independent compartments individually supplying water to said moistening member and an associated pivoting moistening deflector mounted above said path and adapted to be actuated between a raised rest position and a lowered moistening position, said device further comprising a slide bar pivoted to said reservoir to the front of said moistening member relative to the direction of forward movement of articles to be moistened and adapted to be actuated between a protection position in which it adjoins the front of the projecting part of the moistening member substantially flush with the level of said path and a retracted position in which it is retracted under said projecting part of said moistening member and the level of said path, said bar being actuated at substantially the same time as said deflector.

According to another characteristic of the invention the deflector and the bar are coupled by means encroaching upon the path from the side to operate them simultaneously.

The characteristics and the advantages of the present invention will emerge more clearly from the following description of one embodiment of the invention given by way of example with reference to the appended diagrammatic drawings.

DETAILED DESCRIPTION OF THE INVENTION

Figure 1:
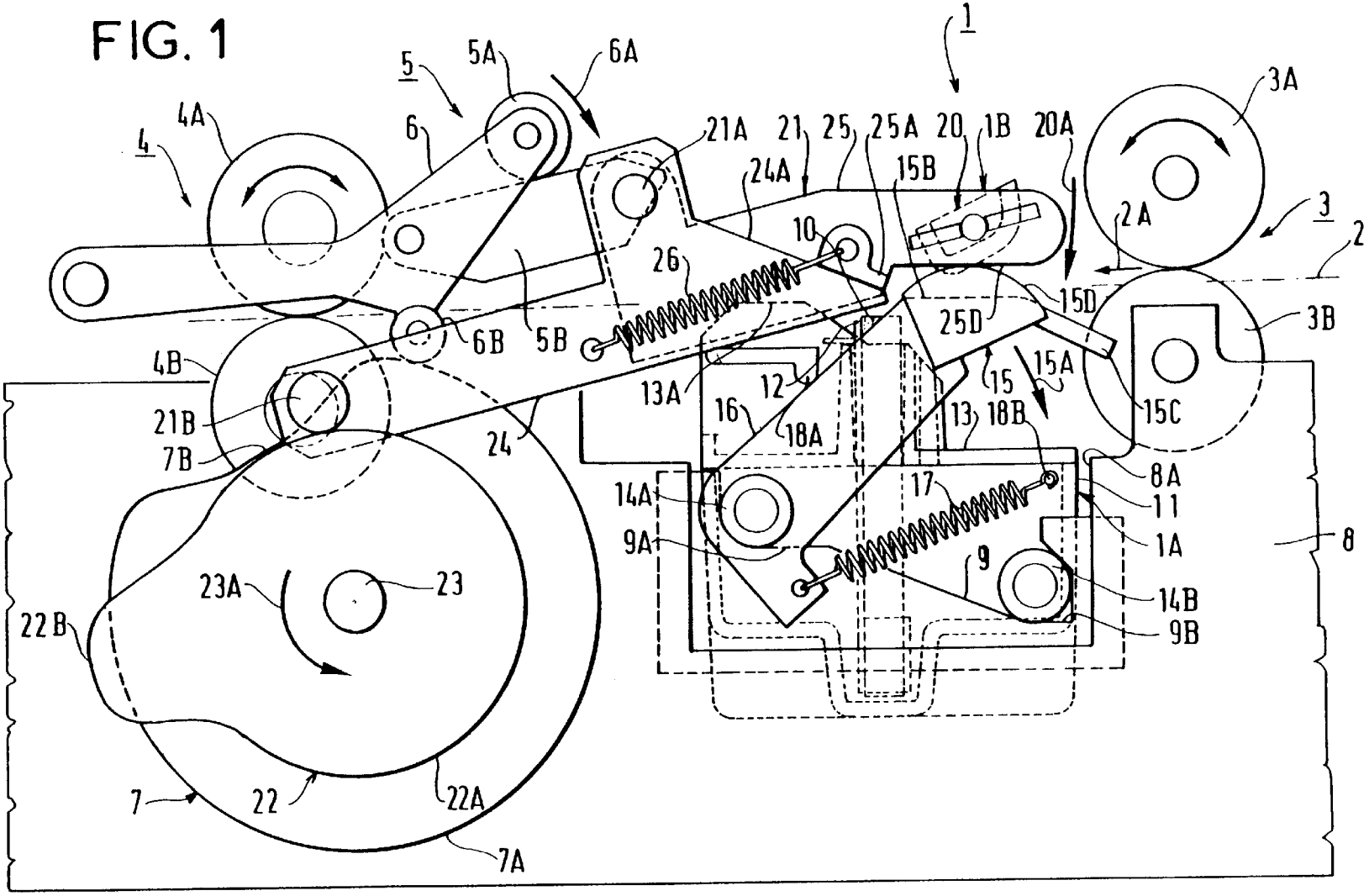
FIG. 1 is a schematic view in elevation showing a mail handling machine using a moistening system in accordance with the present invention mounted in a moistening device in accordance with the present invention.

FIG. 1 shows a mail handling machine including a device 1 in accordance with the present invention for moistening the flaps of envelopes.

The moistening device 1 is mounted on an envelope path 2 of the machine along which the envelopes are fed flat. Pairs of sets of rollers 3A, 3B and 4A, 4B, between which the moistening device 1 is disposed, define the path 2 and feed the envelopes. The arrow 2A represents the forward movement of the envelopes along the path. The general organization of the machine is known as such. It will now be briefly described.

In the machine, the pair of sets of rollers 3A, 3B forms part of an envelope filling device 3 or, alternatively, receives filled envelopes. With the pair of sets of rollers 4A, 4B it feeds filled envelopes along the path with the flap unfolded, flat and to the rear of the body of the envelope as it passes through the moistening device. The pair of rollers 4A, 4B also constitutes a device 4 for ejecting envelopes from the path 2.

In the machine, a device 5 for closing the envelopes is mounted between the moistening device 1 and the ejector device 4. This closing device 5 comprises a pair of presser members 5A, 5B. The members 5A and 5B are spring-loaded into contact with each other and are mounted on a common pair of articulated arms 6. The upper member 5A is a roller and the lower member is an elongate cross-section extrusion or like member. The pair of presser members 5A, 5B pivots with respect to the path 2, as shown by the arrow 6A, between a rest position, which is the position shown in FIG. 1 and in which it is away from the path, and a closing position in which it intersects the path with its members on respective sides of the path. A pair of cams 7 actuates it and holds it in one or other of its two positions. A roller 6B on each arm 6 is pressed against the corresponding cam. Each cam 7 has on its periphery a profile 7A for moving the pair of presser members into the rest position and holding it there and a profile 7B for moving it to the closing position and holding it there.

In the machine, the moistening device 1 can moisten the flaps passing through it or not, depending on whether the envelopes are to be closed or not. Each envelope is closed in two stages by the pair of presser members 5A, 5B in the closing position when the previously moistened flap reaches it. In a first stage, when the envelope is moving forward and the flap reaches the pair of presser members the flap is folded initially to a position at substantially 90° to the body of the envelope. In a second stage the envelope is fed in the opposite direction, back along the path, whereupon its flap passes between the pair of presser members and is folded completely against the body of the envelope, to seal it. The movement of the envelope along the path is again reversed and the pair of rollers 4A, 4B ejects it from the path. If the envelopes are not to be closed the flap of each envelope passes through the moistening device without being moistened and then passes under the pair of presser members 5A, 5B held in the rest position. It is then ejected directly, without any movement back along the path.

The moistening device 1 includes a moistening system 1A disposed under the path 2 and an associated moistening deflector 1B disposed above the path.

The moistening system 1A includes a moistening member 10 mounted in a water reservoir 11. The moistening member 10 is carried by a support 12 which supports it on the reservoir; it dips into the water and projects above the reservoir which is closed by a lid 13 through which the moistening member passes. A series of fins 13A on the lid 13 extend along the edge of the moistening member that is its rear edge with reference to the forward direction of envelopes on the path 2 shown by the arrow 2A. The reservoir 11 forms together with the moistening member 10 that it carries the moistening system 1A in accordance with the present invention. It will now be described in detail.

The moistening device 1 shown in FIG. 1 is generally as described in copending application serial entitled: "DEVICE FOR SELECTIVELY MOISTENING ENVELOPE FLAPS". A succinct description of this device will now be given.

The moistening system 1A is disposed transversely under the path 2, the moistening member 10 being at a slight distance below the path whereas the vertical fins 13A are flush with the level of the path. It is directly disposed between two lower flanges of the machine like the sketched in flange 8. To this end the reservoir 11 has two projecting fingers 14A, 14B on each of its shorter sides, substantially at a top corner and at the opposite bottom corner. Each flange 8 has a rectangular notch 8A in which an attached support part 9 defines two lateral housings 9A, 9B for retaining the two projecting fingers 14A, 14B. The reservoir 11 is directly mounted and held without play between the flanges by tilting it to insert each of the lower projecting fingers into its retaining housing and then returning it to the horizontal position while simultaneously sliding each top finger into its retaining housing. It can be removed equally easily.

The moistening system 1A further includes a pivoting slide bar 15 associated with the moistening member 10. It extends to the front of the moistening member and has a substantially flat surface 15B over which the envelopes slide. It is advantageously carried by the reservoir 11, being pivoted to the front of the moistening member 10. It is mounted at the end of a pair of arms 16 which extend along the outside of the shorter sides of the reservoir 11, where each is articulated to the respective projecting finger 14A. A spring 17 fixed to each arm 16 and attached to the corresponding shorter side of the reservoir holds the slide bar resiliently in a raised rest position from which it is actuated as shown by the arrow 15A into a lowered retracted position. In the raised position the bar is just in front of the moistening member, with its sliding surface 15B projecting slightly above the moistening member so as to be in the plane of the path 2. This raised rest position is a protection position in which the slide bar prevents any contact between the envelope flap and the moistening member. A stud 18A on each shorter side of the reservoir forms an abutment for the arm 16 in the raised rest position of the bar. Another stud 18B on each shorter side of the reservoir forms an abutment for the arm 16 in the lowered position of the bar. This lowered, retracted position is a moistening position in which the envelope flap is brought into contact with the moistening member.

The bar has discontinues depending lips 15C on its leading edge. It also has half-round end portions 15D which project above the sliding surface 15B and project laterally onto the path 2.

The moistening deflector 1B is adapted to cooperate with the moistening member 10 and the slide bar 15. It includes a deflector 20 which extends widthwise over the path 2 and slightly in front of the moistening member. It is carried at the end of a pair of arms 21 articulated about an intermediate axis 21A and actuated in the opposite direction to the deflector by a pair of cams 22. A roller 21B carried by each arm 21 provides the coupling between the pair of arms and the pair of cams. The pair of cams 22 and the pair of cams 7 are rotated by the same drive motor shaft 23. The arrow 23A shows the direction in which this shaft rotates. On the periphery of each cam 22 a profile 22A holds the deflector in the raised rest position and a second profile 22B holds it in the lowered moistening position. The arrow 20A shows the actuation of the deflector to the lowered position. In the rest position the deflector is above the path. In the lowered position it intersects the plane of the path in front of the moistening member.

To enable the deflector 20 to be held resiliently facing the path and so allow for varying thicknesses of envelopes, the arms 21 are each in two parts, namely an actuator lever 24 and a deflector support 25. The lever and the support are both articulated at 21A; they are also coupled together by a spring 27 which hold a rib 25D on the support against a ramp 24A for it on the lever.

The actuation of the moistening deflector from its rest position to its moistening position as shown by the arrow 21A advantageously moves the slide bar simultaneously to the lowered retracted position. This simultaneous actuation is achieved by the pair of cams 22 and means for coupling the deflector 20 or its arms 21 with the slide bar 15 or its arms 16. The coupling means shown are defined by the profile of the lower edge 25D of each deflector support 25 which constitutes a presser member and by the corresponding semicircular shoulder 15D on the slide bar 15 which constitutes an abutment for the presser member. The spring 17 returns the slide bar to the raised rest position when the deflector 20 returns to the raised rest position.

In the moistening system 1A the moistening member 10 is a flat member mounted vertically in the reservoir. It is, for example, a flat felt pad, a flat sponge, a flat brush or the like. It is carried by its flat support or holder 12, one of its larger surfaces being in contact with one surface of the holder. How it is mounted on the reservoir will be explained in the description of the moistening system 1A given with reference to the remaining figures.

Figure 2:
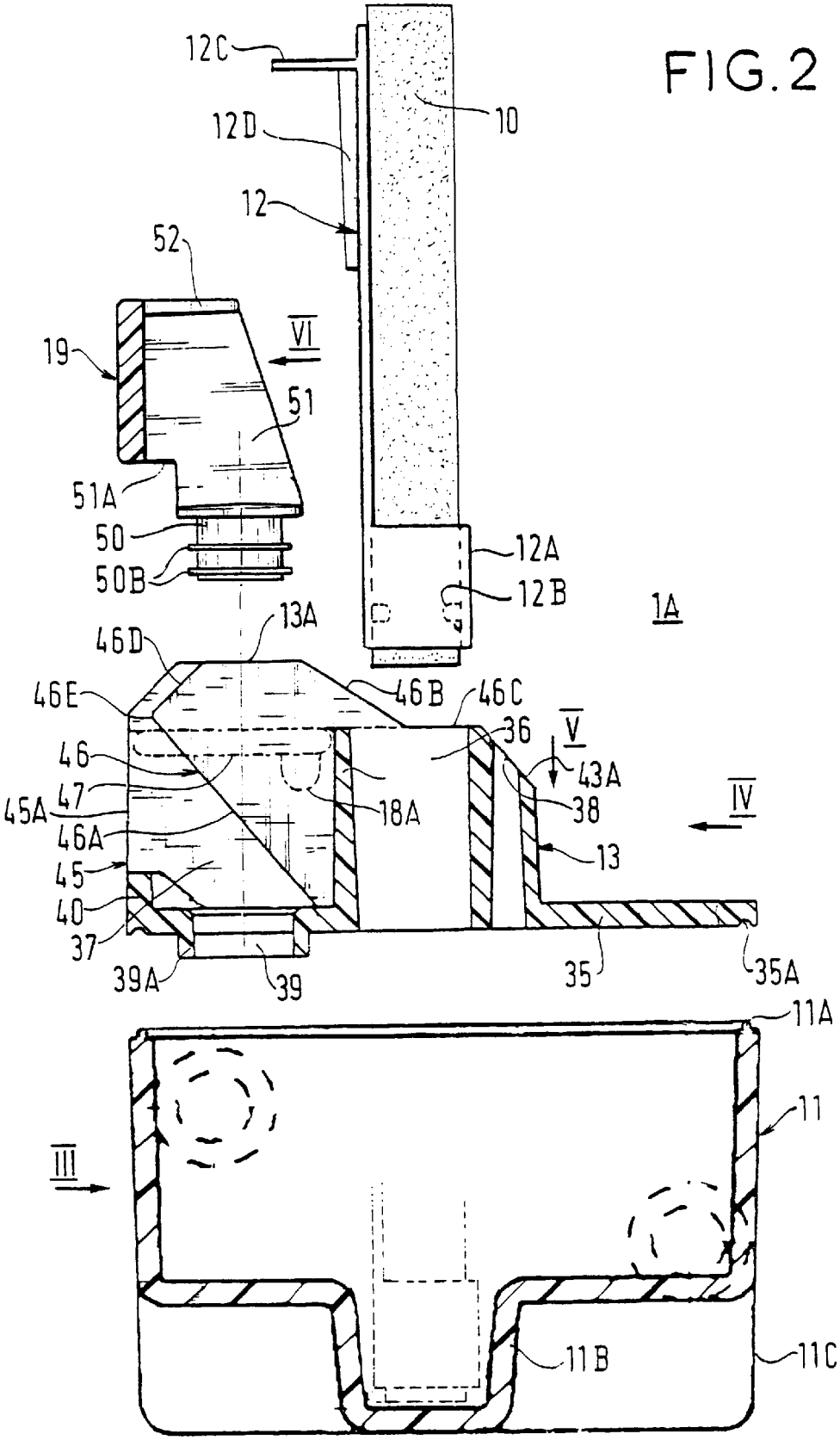
FIG. 2 is an exploded schematic view of the moistening system from FIG. 1 partly in cross-section and with some parts omitted.

FIG. 2 shows the moistening system 1A minus the slide bar carried by the reservoir 11. It shows that the moistening system further includes a plug strip 19 matching the lid 13 and enabling the reservoir 11 to be filled and then closed.

The reservoir 11 will be described with reference to FIGS. 2 and 3. It is elongate and relatively narrow; it constitutes a substantially parallelepiped-shape cross-section water reservoir. It extends across the width of the path. Its upper side is open. It has a small rib 11A around the edge for locating the lid. Its bottom includes a substantially central U-shaped recess 11B along its length. This defines a narrow internal channel receiving the lower end of the moistening member on the holder, as indicated in dashed outline in FIG. 2. Its side walls 11C have a height corresponding to the level of the bottom of the reservoir inclusive of the channel 11B.

Figure 3:
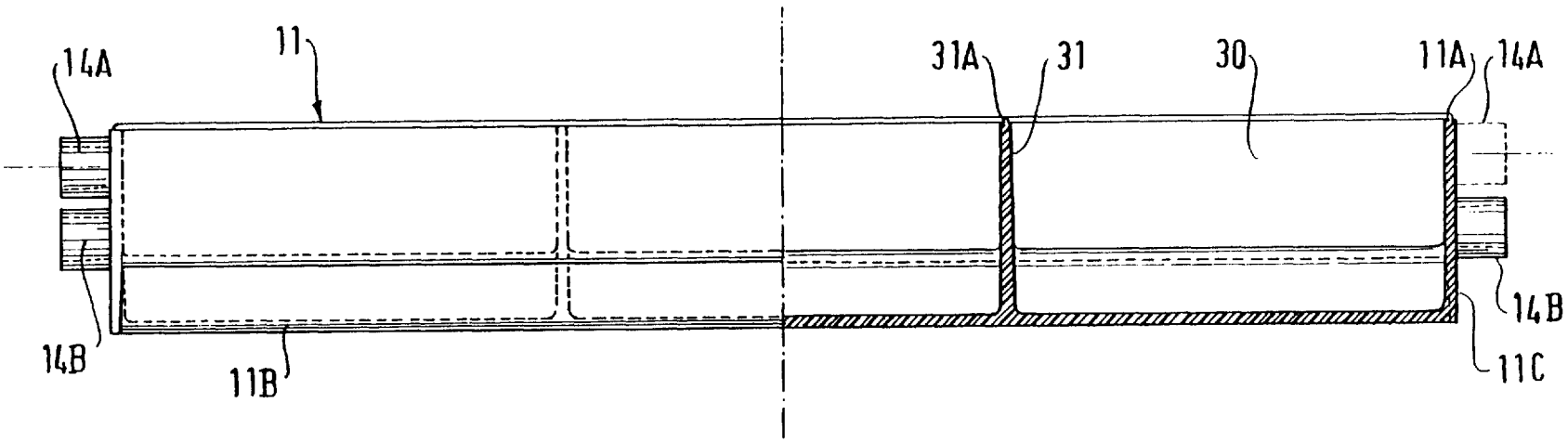
FIG. 3 is a view of the reservoir part of the moistening system from FIGS. 1 and 2 partly in elevation in the direction of the arrow III in FIG. 2 and partly in longitudinal cross-section.

FIG. 3 shows that the reservoir 11 is compartmented along its length. It is shown with three identical compartments 30 defined by two transverse partitions 31. The partitions extend over the full height of the reservoir 11, inclusive of the channel 11B. The three compartments are independent and isolated from each other when the lid 13 has been fitted to the reservoir 11. Each partition 31 has on it a rib 31A analogous to the peripheral rib 11A on the upper edge of the reservoir.

The reservoir 11 carries on each of its shorter sides the two projecting fingers 14A, 14B previously mentioned which secure the reservoir and therefore the resulting moistening system 1A into the machine of FIG. 1. The fingers 14A define the axis of articulation of the slide bar carried by the reservoir.

Being compartmented in this way, the reservoir 11 divides the water it contains into three substantially identical amounts. In this way it secures a balanced distribution of the individual masses of water and so facilitates mounting the moistening system 1A in the machine and demounting it therefrom and in particular prevents water spilling during such mounting and demounting.

Figure 4:
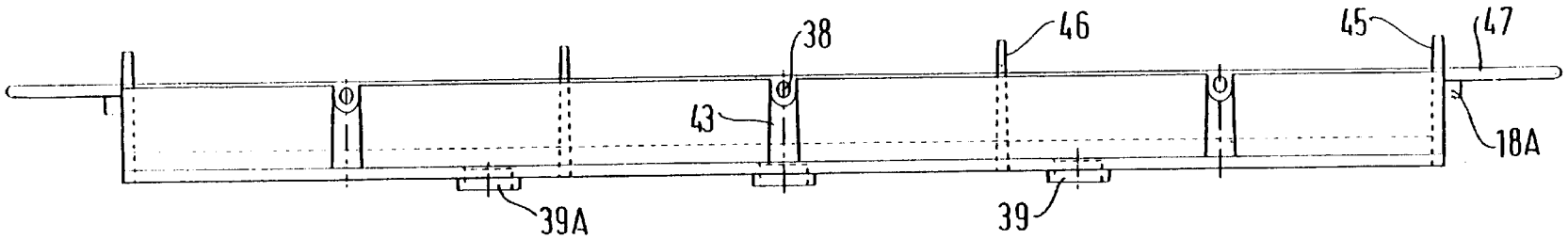
FIG. 4 is a view in elevation of a lid part of said moistening system as seen in the direction of the arrow IV in FIG. 2.

The lid 13 will be described with reference to FIGS. 2, 4 and 5.

The lid has a base 35 whose substantially plane lower surface fits to the upper edge of the reservoir 11 to close it and to this end has a peripheral groove 35A which fits over the peripheral rib 11A on the reservoir.

The lid 13 is appropriately equipped for the three compartments of the reservoir. It has on the upper surface of its base 35 and along its length three chimneys 36 which are aligned substantially along its median part, a reservoir feed trough 37 on one side of the chimneys and three small passages 38 for venting the compartments on the other side of the chimneys.

The chimneys 36 project a considerable distance from the base and open through the base into the respective compartments along their length. They hold three respective identical moistening members 10 mounted on their respective holders, each disposed in one of the three compartments and projecting slightly above the respective chimney.

The trough 37 is on one side of the chimneys and is defined between a vertical lip 40 on one of the longitudinal edges of the base and a longitudinal rib 41 which also forms one wall of the chimneys. The height of the vertical lip is less than that of the rib 41 or of the chimneys; it matches the rear edge of the reservoir mounted in the FIG. 1 machine. The trough 37 communicates with each of the compartments of the reservoir through a circular hole 39 in the part of the base 35 which constitutes the bottom of the trough. The three holes 39 for the three compartments have a lip 39A projecting below the lower surface of the base. The hole for the central compartment is centered on that compartment and those for the two end compartments are offset towards the central compartment.

The three small vent holes 38 advantageously adjoin the other wall of the chimneys formed by a second longitudinal rib 42 similar to the rib 41.

Each of them is formed within an additional thickness portion 43 of the rib 42 substantially in line with the central part of each compartment, which has a bevelled end 43A, as does the rib 42 (FIG. 2).

On the upper surface of the lid 13 are two transverse outer ribs 45 which are in corresponding relationship to the shorter sides of the base 35 and form the short side walls for the two end chimneys and the trough, together with two inner ribs 46 which separate the adjacent chimneys and extend transversely across the trough 37. The ribs 45 and 46 are substantially similar; however, the ribs 46 have their terminal edges 46A slantwise across the trough so as not to compartment it, the terminal edges 46A ending substantially at the bottom of the wall 41A on the base 35 to maintain the continuity of the trough whereas the corresponding terminal edge 45A of each of the ribs 45 is vertical.

Within the trough 37 the ribs 45 and 46 project above the level of the chimneys. The top edges of these ribs form the previously mentioned fins 13A. A front bevel 45B or 46B on each rib forms the transition between the fins 13A and the level of the chimneys, substantially on the median line of their openings. A front flat 45C, 46C extends the bevel as far as the wall 42. A rear bevel 45B, 46B makes the transition between the fins 13A and the terminal edge 45A, 46A of the corresponding rib. The bevel 46D and the slantwise terminal edge 46A of the ribs 46 define an acute angle 46E which helps to retain the plug strip 19.

An external lug 47 is provided on the external surface of each of the end ribs 45 so that the lid can be grasped easily. Under each lug 47 an external boss defines the previously mentioned abutment 18A for the slide bar articulated to the reservoir 11 (FIG. 1).

Figure 5:
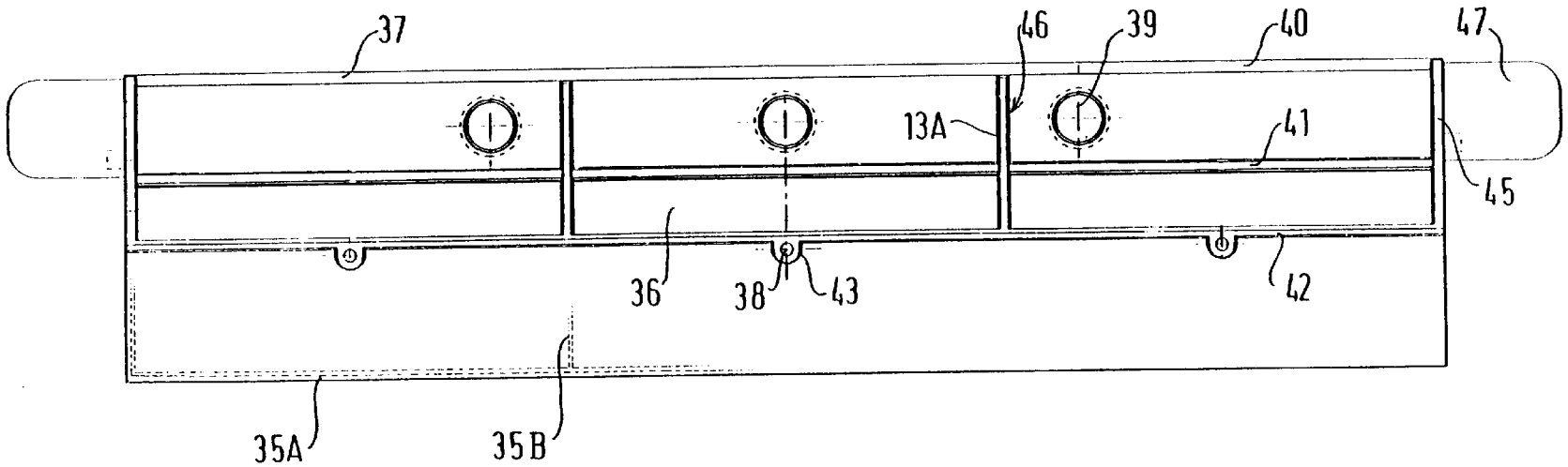
FIG. 5 is a top view of the lid as seen in the direction of the arrow V in FIG. 2.

FIG. 5 shows that the base 35 additionally has on its lower surface two grooves 35B for the ribs 31A on the two partitions 31 of the reservoir 11 (FIG. 3). The grooves 35B are shown in dashed outline like the peripheral groove 35A.

The holder 12 for the moistening member is described with reference to FIG. 2. It serves to mount the moistening member 10 in each of the compartments of the reservoir and to retain it in the corresponding chimney 36 of the lid, the moistening member and the holder comprising as many individual segments as there are compartments; these segments are not separately referenced.

The holder 12 is in the form of a support plate. The height of this support plate is slightly less than that of the moistening member 10 and its length is substantially equal to that of each compartment 30. It mounts vertically in the corresponding compartment and chimney.

It has on one side and along its lower edge a sleeve 12A of rectangular cross-section similar to that of the moistening member. Internal bosses 12B on this sleeve retain the moistening member in the sleeve and against the corresponding surface of the support plate. The sleeve is inserted through the chimney 36 of the lid into the internal channel 11B defined in the bottom of the reservoir 11.

The support plate 12 has on its other side or back a transverse lug 12C which abuts the end of the wall 41 of the chimney when the moistening member is inserted fully into its compartment, its remaining part projecting above the chimney. It also has on its back and just below the abutment lug 12C ribs 12D extending over part of its height. The thickness of these ribs increases gradually from their lower end to their upper end below the abutment lug. They therefore offer no resistance to their insertion into the chimney, against the wall 41, and then lock the member holder 12 with the moistening member between the walls 41 and 42 at the end of insertion.

Figure 6:
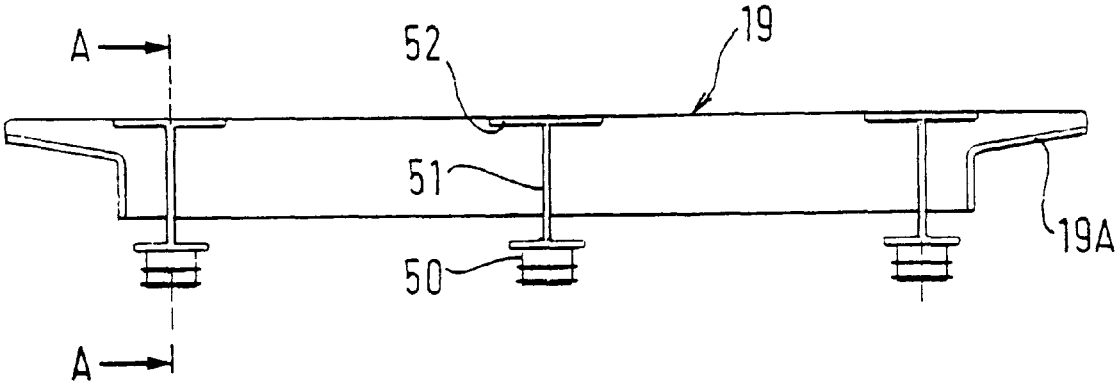
FIG. 6 is a view in elevation of a plug strip part of the moistening system as seen in the direction of the arrow VI in FIG. 2.
Figure 6A:
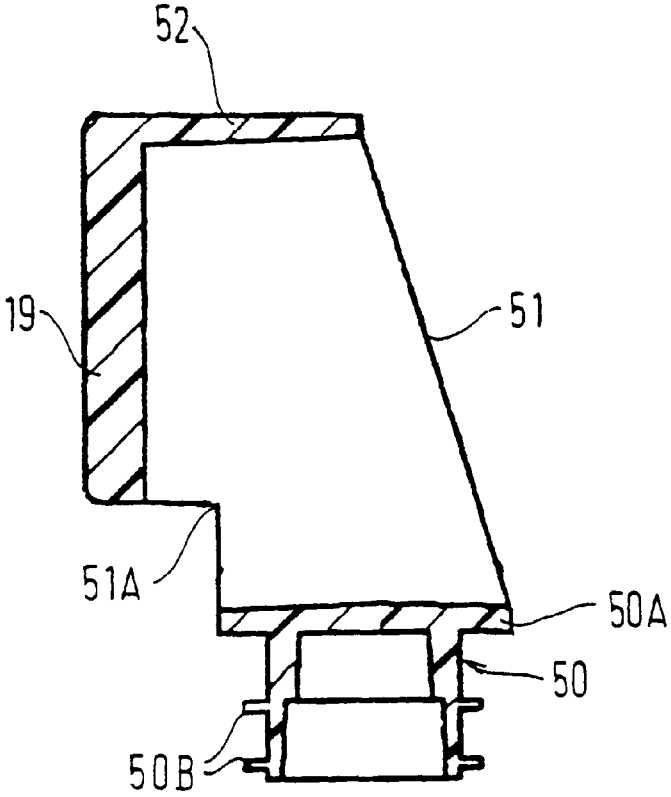
FIG. 6A is a view of the plug strip in cross-section on the line A—A in FIG. 6.

The plug strip 19 will be described with reference to FIGS. 3, 6 and 6A, in which it is shown to different scales.

The plug strip closes the three holes 39 at the bottom of the trough for the three compartments of the reservoir 11. It is formed by an elongate flat support 19 carrying three cylindrical plugs 50. The plugs 50 are at substantially the same distance from each other as are the holes 39. The length of the strip is slightly less than that of the trough 37 and the strip is inserted substantially vertically into the trough with its two end plugs just to either side of the two inner ribs 46 in the trough 37.

The strip 19 has on one side three flexible or resilient walls 51 each carrying one of the plugs which is therefore cantilevered from the strip. The height of the walls 51 is greater than that of the strip, so that their bottom edge is below the bottom edge of the strip. They have a cut-out 51A at the lower edge of the strip, accentuating their elasticity relative to the strip. Each cylindrical plug is vertically disposed at the end of each resilient wall, the lower edge of the wall lying along a diameter of an end surface or head 50A of the plug.

The strip also has semicircular pressure cups 52 projecting from its upper edge and above the elastic walls 51, for forcing each plug 50 into the corresponding hole 39.

The elasticity of the walls 51 and in particular of their lower part carrying the plugs enables recentering of the plugs in the holes 39 if necessary.

Two end notches 19A in the lower edge of the strip and the reduced length of the strip as compared with the trough enable it to be grasped and facilitate removal of the plugs for filling the compartments of the reservoir via the trough.

The plugs are identical. Each has two projecting rings 50B on its periphery which are inserted in turn into the holes 39 and locked under their lower edge to close each of the compartments effectively. In the position in which each hole 39 is completely closed by its plug the lower edge of the strip bears on the end of the rim 40 on the lid forming the outside wall of the trough. During insertion the strip is guided against the projecting corners 46E of the ribs 46; in the closed position it is held vertically against them.

The plug strip 19 is of unitary construction. It does not introduce any additional bulk into the moistening system 1A. It enables easy and simultaneous filling of the reservoir compartments. The water is distributed virtually identically between the different compartments.

In the moistening system 1A the reservoir 11, the lid 13, the moistening member holder 12, the plug strip 19 and the slide bar 15 are preferably all molded from plastics material. The lid is preferably fixed irremovably to the reservoir 11 by ultrasonic welding so that the compartments are totally isolated from each other and from the outside environment.

The moistening system in accordance with the present invention has many advantages. In particular, it is easy to mount in any type of moistening device, and to demount therefrom, without risk of causing any damage during such mounting, demounting or filling. What is more, filling is quick and simple. Its moistening member is very simple in itself and very easy to fit and replace if necessary. It is particularly well suited to the aforementioned moistening device 1 in which it is mounted and is easy to fit with a slide bar to cooperate effectively with the deflector of that moistening device. Of course, it can be used in any other moistening device without an associated deflector or with a different deflector.

The moistening system is of compact overall dimensions. All its individual component parts are easy and inexpensive to manufacture and easy to assemble and to replace if necessary.

The present invention has been described with reference to the embodiment shown. It is evident that without departing from the scope of the present inventions details thereof may be modified and/or some means replaced by other equivalent means or other means adapted to the device in which it is to be mounted. Note in particular that the moistening member on its holder, which comprises as many individual segments as there are compartments, could be segmented only in its lower part in the compartments. The upper part of the moistening member could then be continuous and retained by one chimney running the entire length of the lid.

What is claimed is:

1. Moistening system comprising:

a moistening member; and a water reservoir, said moistening member being mounted on said reservoir and having a projecting part for moistening envelope flaps of postal articles as said articles move along a path and said flaps of said articles are applied against said projecting part, said reservoir being mounted with said moistening member carried thereby transversely below the path and extending over substantially the entire width of the path and said reservoir including a series of partitions dividing said reservoir across the width of the path into independent compartments, with said compartments individually supplying water to said moistening member, wherein said reservoir has an upper surface closed by a lid incorporating a base matched to the dimension of the upper surface, and wherein said lid comprises a longitudinal feed trough on an exterior side of said base which communicates with said compartments through holes in the bottom of said trough.

2. Moistening system according to claim 1 wherein said reservoir is in the form of an elongate narrow parallelepiped-shape reservoir having a length substantially equal to the length of said path and in which said partitions defining said compartments extend over the full height of said compartments and said moistening member extends over the length of the reservoir and is disposed vertically in the reservoir and dips into said compartments.

3. Moistening system according to claim 2 wherein said moistening member passes through said lid and is received in part in said compartments.

* * * * *